US006547546B1

(12) United States Patent
Stroganov et al.

(10) Patent No.: US 6,547,546 B1
(45) Date of Patent: Apr. 15, 2003

(54) ROTARY MACHINE

(76) Inventors: Alexandr Anatolievich Stroganov, 195253 ul. Stasovoi, d.2, kv. 479, S-Petersberg (RU); Alexandr Nikolaevich Zimnikov, 198239 ul. Tombasova, d. 6, k. 1, kv. 107, S-Petersberg (RU)

( * ) Notice: Subject to any disclaimer, the term of this patent is extended or adjusted under 35 U.S.C. 154(b) by 0 days.

(21) Appl. No.: 09/787,635

(22) PCT Filed: Sep. 29, 1998

(86) PCT No.: PCT/RU98/00312

§ 371 (c)(1),
(2), (4) Date: Mar. 20, 2001

(87) PCT Pub. No.: WO00/19102

PCT Pub. Date: Apr. 6, 2000

(51) Int. Cl.[7] ..... F01C 21/16

(52) U.S. Cl. ..... 418/228; 418/229; 418/228; 418/230; 418/231; 418/232; 418/22; 418/28

(58) Field of Search ..... 418/228, 229, 418/230, 231, 232, 22, 23, 28, 219

(56) References Cited

U.S. PATENT DOCUMENTS

| | | | | | |
|---|---|---|---|---|---|
| 1,527,685 | A | * | 2/1925 | Huwiler | 418/28 |
| 2,927,430 | A | * | 3/1960 | Castles, Jr. | 418/22 |
| 2,977,889 | A | * | 4/1961 | Fisk | 418/28 |
| 3,250,223 | A | * | 5/1966 | Krawacki | 418/22 |
| 4,046,493 | A | * | 9/1977 | Alund | 418/22 |
| 4,561,831 | A | * | 12/1985 | Mallen-Herrero et al. | 418/28 |
| 5,022,842 | A | | 6/1991 | Sakamari | |
| 5,026,263 | A | | 6/1991 | Iwata | |
| 5,509,793 | A | * | 4/1996 | Cherry et al. | 418/219 |
| 5,524,587 | A | * | 6/1996 | Mallen et al. | 418/24 |

FOREIGN PATENT DOCUMENTS

| | | | | |
|---|---|---|---|---|
| DE | 428964 | * | 5/1926 | 418/22 |
| EP | 65607 | * | 12/1982 | 418/28 |
| FR | 2578585 | * | 9/1986 | 41/22 |
| JP | 03-100391 | * | 4/1991 | 418/67 |
| RU | 2056536 C1 | | 3/1996 | |
| SU | 1051332 A | | 10/1983 | |

* cited by examiner

*Primary Examiner*—Thomas Denion
*Assistant Examiner*—Theresa Trieu
(74) *Attorney, Agent, or Firm*—Christopher L. Pharmelee; Walker & Jocke LPA

(57) ABSTRACT

The present invention may be used in pumps and hydraulic engines and increases the functional capacities of rotary machines. This invention relates to a rotary machine comprising a body in which an adjustment member is mounted so as to be capable of displacement along the rotation axis. A plurality of systems, that define the axial and mutual disposition of sliders, are mounted so as to be capable of changing their position relative to the rotor and the body, and are cinematically connected to the adjustment member. The sliders are mounted so as to be capable of changing their position upon displacement of the adjustment member.

52 Claims, 3 Drawing Sheets

ROTARY MACHINE

BACKGROUND OF THE INVENTION

The invention refers to mechanical engineering and can be applied in pumps and hydraulic motors. Liquids and gases are used in the rotor machine as the working medium. Under the term "regulation" the adjustment of the machine for a certain volume of the working volume is meant Hence in case of application of the machine as a pump it is possible to change the flow rate and in case of using it as a hydraulic motor—to change rotation speed on the shaft. A rotor machine is known (application for European patent No 0261682 that is composed of a rotor located inside the housing. The rotor has radial slots in which slide valves are mounted arranged in such a way that they can shift radially. In radial direction the working chamber is restricted by the rotor surface and the internal peripheral surface of the housing that has elliptical cross-section. During rotation of the rotor slide valves are moved out of the rotor under the action of centrifugal forces and are pressed against the internal surface of the housing which serves as a component assigning radial mutual position of slide valves and they slide over this surface thus creating low- and high pressure zones in the working chamber.

In the axial direction the working chamber is restricted by two end members one of them being in contact with one of the rotor end and is movable in the axial direction and the second one being mounted on the other side of the rotor and rotates together with it This second end member (referred to in the said application as the member that changes the capacity of the machine) has a cavity into which a part of the rotor with slide valves in inserted. The length of the part that is not inserted into the cavity of the second end member determines the axial length of the working chamber.

By shifting the first end member movable in the axial direction the rotor can be moved into the cavity of the second end member to a greater or smaller length thus changing the length of the working chamber and accordingly its volume.

Similar machines in which slide valves move inside the rotor in radial direction are described in international application No 88/02438 and in British application No 2207953. In these machines it is also possible to change the volume of the working chamber however unlike the machine described above the volume of the working chamber is varied not by changing its axial but the radial dimension. E.g. in the machine described in British application No 2207953 slide valves mounted inside the rotor are pressed by springs to the internal profiled surface of the ring that encircles the rotor. This ring is fitted with a segment movable in radial direction and located in the zone between the inlet and outlet openings of the machine. Radial position of the segment determines the volume of the working chamber of the machine. In the rotor machine described in international application No 88/02438 the rotor is installed so that it can slide in the housing, the internal peripheral wall of which has elliptical cross-section in the direction perpendicular to the axis of rotation. The disadvantage of rotor machines with radially moving slide valves are difficulties connected with provision of tightness of the working chamber as the working chamber has surface areas with varied curvature.

The rotor machine (British Application No. 1469583) is chosen as the closest analog. This machine contains a rotor with radial slots in which slide valve moving along the rotation axis of the rotor are mounted. The working chamber of the machine is restricted in the axial direction by opposite ends of the housing and the rotor and in radial direction—by areas of the surface of the rotor shaft and the internal cylindrical surface of the housing located between the said ends of the rotor and the housing. A partition is installed inside the working chamber that separates the inlet and outlet openings and it is in sliding contact with the adjoining rotor end and the rotor shaft. As the rotor rotates slide valves make a complicated motion rotating together with the rotor and moving simultaneously along its axis of rotation. When slide valves are remote from the partition they enter into the working chamber out of the rotor. As the slide valves approach the partition in the process of rotation of the rotor they move gradually into the rotor and occupy such a position when they do not project over the rotor end. In this position they pass the partition without touching it when the rotor rotates.

In order to provide axial movement of slide valves special members are mounted in the rotor slots that assign axial mutual position of slide valves—it is a groove cut in the internal surface of the housing with profiled surface into which slide valve edges enter. This sinusoid—like groove plays the role of a master cam and assigns the character of the axial movement of slide valves in slots of the rotor during its rotation.

The disadvantage of the machine described in British application No 1469583 is that the volume of the working chamber cannot be changed. As it was mentioned above the working chamber is restricted from one side by the end of the rotor that is non-movable in the axial direction and from the other side- by the end of the housing. Hence the machine of this type can be designed so as to work with maximal efficiency under definite operational conditions. When the conditions are changed such machine will work less efficiently or even unsatisfactorily.

SUMMARY OF THE INVENTION

The purpose of this invention is to develop a regulated rotor machine with reciprocating motion of slide valves along the rotation axis of the rotor which enables to extend functional capacities of rotor machines with such motion of slide valves and to avoid disadvantages typical for machines with radial motion of slide valves.

The problem is solved in the following way. The rotor machine contains the housing with inlet and outlet openings, the rotor mounted inside the housing with at least two slide valves that can move in the direction along the axis of its rotation; the working chamber restricted in the direction along the rotation axis of the rotor by its first end; the partition inside the working chamber fixed on the internal surface of the housing so that it separates the inlet and outlet openings and is in sliding contact with the said rotor end; members that assign axial mutual position of slide valves and according to the invention is provided with a regulating member which is fixed inside the housing and is free to move in the direction along the rotation axis of the rotor. The regulating member restricts the working chamber along the rotation axis from the opposite side and is connected with the members that assign the axial mutual position of slide valves. The members that assign the axial mutual position of slide valves are mounted so that they can change their position with respect to the housing with the rotor and are connected cinematically with the regulating member; the slide valves are installed so that they can change their position with respect to the rotor when the regulating member is in motion; in this case slide valves located inside the working chamber are in sliding contact with the end of the regulating member and separate the inlet opening from the outlet one. The length of axial projection of the slide valve is the distance between the rotor end to the slide valve end, moved out of the rotor into the working chamber of the machine. The change of the volume of the working chamber in the proposed rotor machine is effected due to the change of its axial length when the regulating member is moved to one or another side with respect to the rotor. Besides to balance the load on the second rotor end opposite the rotor end that faces the working chamber and to exclude the influence of the slide valve volume on the uniformity of the machine feed and its capacity the machine can be fitted with a supporting and distributing member that is fixed inside the housing and is in sliding contact with the other rotor end. Two cavities separated from each other are provided in the said end of the supporting and distributing member. One of these cavities is connected by a channel with the inlet opening and the other one—with the outlet opening.

In order to reduce hydraulic losses during reciprocating motion of slide valves, to reduce their weight and to balance the force of pressure acting on the slide valve end facing the working chamber and the opposite end a through opening is provided in each slide valve which begins on the slide valve end facing the working chamber and ends on the slide valve end opposite to the said slide valve end.

In order to reduce axial vibration of the rotor through channels can be made in it them that connect opposite rotor ends between two adjacent slide valves.

Like machines of other types this machine can be of multi-chamber design and have more than one partition and regulating member the number of cavities provided in the end of the supporting and distributing member being increased accordingly.

BRIEF DESCRIPTION OF THE DRAWINGS

The subject of the invention is explained by drawings, including.

DETAILED DESCRIPTION OF THE INVENTION

Figure 1:
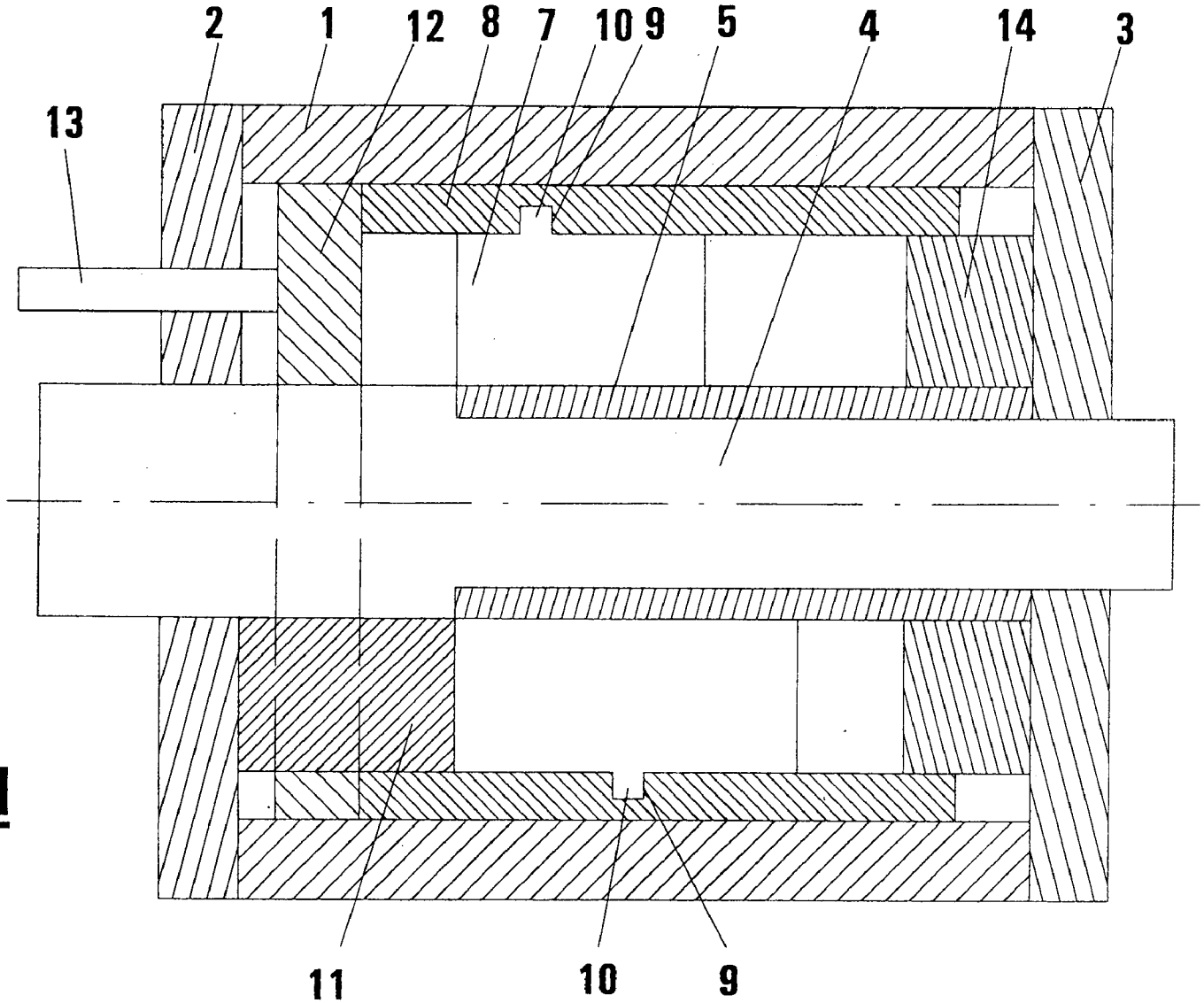
FIG. 1 shows a longitudinal section of the machine.

The rotor machine (FIG. 1) contains housing 1 with covers 2 and 3. Rotor 5 on shaft 4 is placed in the middle of the cylindrical opening drilled in housing 1. Radial slots 6 are provided over the whole length of rotor 5 with sliding valves 7 inserted into them so that they can perform reciprocating motion along the rotation axis of the rotor. The number of sliding valves can be two or more. There are special members located inside the housing that assign axial mutual position of sliding valves in slots 6 of rotor 5 and the length of their maximal axial travel out of rotor 5 into the working chamber.

According to the design presented in the drawings these members are made in the form of hollow cylinder 8 on the internal cylindrical surface of which an enclosed curvilinear groove 9 is cut. This hollow cylinder 8 is fitted on rotor 5 the external radial surface of rotor 5 and the internal cylindrical surface of hollow cylinder 8 being in sliding contact. The cylinder is fixed inside housing 1 so that it can slide over the surface of rotor 5 along its rotation axis not rotating together with the rotor. Beside each sliding valve 7 has projection 10 which enters recess 9 of hollow cylinder 8 and is in sliding contact with it. The machine is provided with partition 11 fixed on the internal surface of the housing, particularly it is fixed on cover 2 of the housing. Partition 11 adjoins the first end of rotor 5 that faces this cover 2 of the housing and shaft 4 of the rotor 5 which are in sliding contact. Recess 9 is made so that sliding valves 7 located opposite the end of the partition 11 adjoining the first end of rotor 5 enter rotor 5 to an equal length and some sliding valves that are remote from partition 11 are moved out of the rotor 5 and are in sliding contact with the end of regulating member 12 thus separating the inlet opening 16 from the outlet opening 17. Regulating member 12 is placed between housing cover 2 and the first end of rotor 5 so that it can move along the rotation axis of rotor 5. Regulating member 12 restricts the axial length of the working chamber. The axial length of the working chamber is the distance between the end of regulating member 12 and the end of rotor 5 which face each other.

According to the design regulating member 12 presented in the drawing is made as a disk with the central opening through which shaft 4 of rotor 5 passes and has a cutout through which partition 11 passes. This disk is placed so that it can slide over shaft 4 along its rotation axis not rotating with it. Regulating member 12, particularly disc with a slot is fixed to the end of hollow cylinder 8 and they can form a single component of the machine. Setting rod 13 is fixed to regulating member 12. This bar can move along the rotation axis of rotor 5 and projects out of the housing.

Thus the cavity of the working chamber is restricted in the direction along the rotation axis of rotor 5 by the first end of rotor 5 and the end of regulating member 12 that faces the first end of rotor 5 and in the radial direction is restricted by radial insulation members. It is only insulation members that prevent the working medium from flowing out of the working chamber. According to the design radial insulation members presented in the drawings are the surface of shaft 4, the surface of partition 11 and the internal surface of hollow cylinder 8.

Supporting and distributing member 14 is fixed on cover 3 of the housing. This member can form a single component with cover 3. The end of supporting and distributing member 14 is in sliding contact with the second end of rotor 5. There are two separated cavities 22, 26 in the end of the supporting and distributing member 14. One of the cavities 22 is located opposite the working chamber cavity 28, which is connected with the inlet opening 16. The cavity 22 is connect with the cavity 28 by a channel 20. The second cavity 26 is located opposite the working chamber cavity 30, which is connected with the outlet opening 17. The cavity 26 is connected with the cavity 30 by another channel 24.

Figure 2:
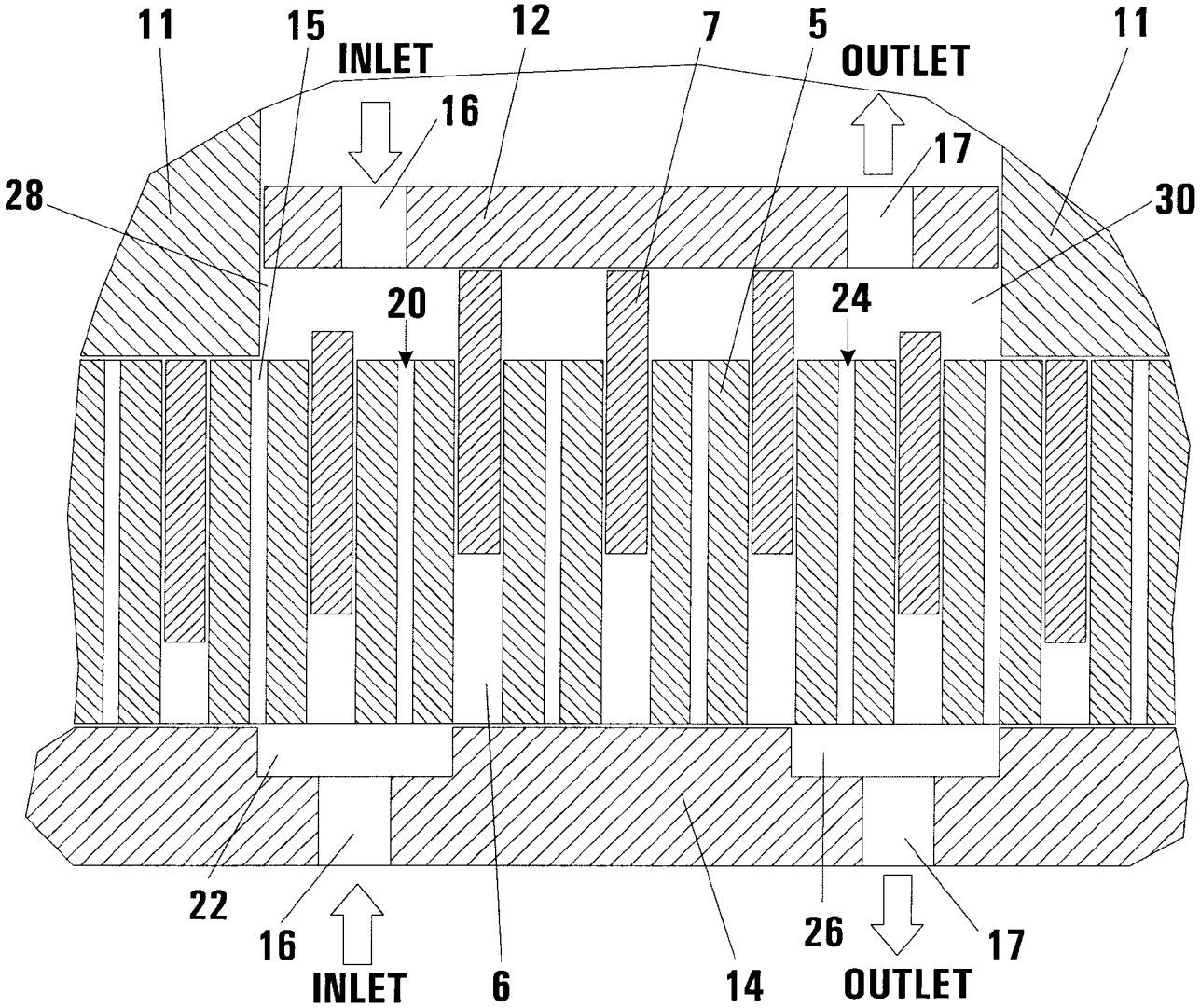
FIG. 2 shows a development of the rotor and side cylindrical surface of the machine.

Besides through channels 15 are made in rotor 5 to connect opposite ends of rotor 5 between adjacent sliding valves 7 (see FIG. 2).

The machine can work in the pump mode and in the hydraulic motor mode. The machine operates in the pump mode in the following way. The volume of the working chamber is assigned by setting rod 13 with respect to housing cover 2 and if necessary it can be changed during operation. Accordingly regulating member 12 occupies a certain position with respect to the first end of rotor 5 and restricts the axial length of the working chamber and hence—its volume. Hollow cylinder 8 connected with regulating member 12 has curvilinear groove 9 into which projections 10 of sliding valves 7 enter. As regulating member 12 is in motion cylinder 8 shifts accordingly and assigns the length of maximal penetration of sliding valves inside the working chamber. After starting the machine when rotor 5 begins to rotate projections 10 of sliding valves 7 start to slide over curvilinear groove 9 of hollow cylinder 8 and make reciprocating motion along the rotation axis of rotor 5 which is transferred to sliding valves 7. Groove 9 is made so that the motion of slide valves 7 per revolution of rotor 5 is characterized by the following cycle. Sliding valve 7 located opposite the end of partition 11 is moved into rotor 5. As slide valve 7 shifts off partition 11 it starts moving out of slot 6 into the cavity of the working chamber and at a certain moment its end will touch the end of regulating member 12. Then the end of slide valve 7 slides over the end of regulating member 12 and does not move axially. Next as the valve approaches partition 11 it begins to move into slot 6 of rotor 5 very smoothly and by the moment of passing through partition 11 it will be completely moved into rotor 5.

When sliding over the end of regulating member 12 slide valve 7 separates the working chamber into two cavities; in one of them the low pressure zone is formed in the other cavity- the high pressure zone which are connected respectively with the inlet and outlet openings of the machine. The inlet and outlet openings are not shown in the drawing not to complicate it. The volume of the working medium contained between two adjusting slide valves 7 that slide over the end of regulating member 12, is transferred from the low pressure zone into the high pressure zone. The force of pressure acting from the working chamber side against the first end of rotor 5, is compensated by supporting and distributing member 14 the end of which is in sliding contact with the second end of rotor 5. Two separated cavities provided in the end of the supporting and distributing member 14 are located so that one of them is opposite the cavity of the working chamber with the low pressure zone and the other—opposite the cavity with the high pressure zone. The opposite cavities of the working chamber and supporting and distributing member 14 are connected by a channel and form opposite lying low- and high pressure zones that compensate the axial load on the end of rotor 5. During rotation of rotor 5 as slide valve 7 moves off partition 11 it penetrates into the cavity of the working chamber with the low pressure zone and brings its volume into it However on the other hand exactly the same volume of the working medium fills slot 6 in which this slide valve 7 is located out of the opposite cavity of supporting and distributing member 14 with which this slot 6 is connected. Next the end of slide valve 7 located in the working chamber slides over the end of regulating member 12 and the end of the supporting and distributing member 14 sliding over the second end of rotor 5 shuts off slot 6 in which this slide valve 7 is located, in axial direction and separates it from cavities provided in the end of supporting and distributing member 14. As slide valve 7 approaches partition 11 slide valve 7 begins to enter rotor 5 and the volume of the displaced working medium out of the cavity of the working chamber with high pressure zone will be reduced by the value of the part of the volume of slide valve 7 which moves into rotor 5. But exactly the same volume of the working medium is displaced into the cavity of the supporting and distributing member 14 located opposite the cavity of the working chamber with high pressure zone as slot 6 in which this slide valve 7 is located is connected with the cavity of supporting and distributing member 14 which is connected by the channel with the opposite cavity of the working chamber with the high pressure zone. In this way influence of the volume of slide valves 7 on the capacity and uniformity of the feed is compensated. Working as a hydraulic motor the machine operates in the same way as other types of reversible pumps.

Figure 3:
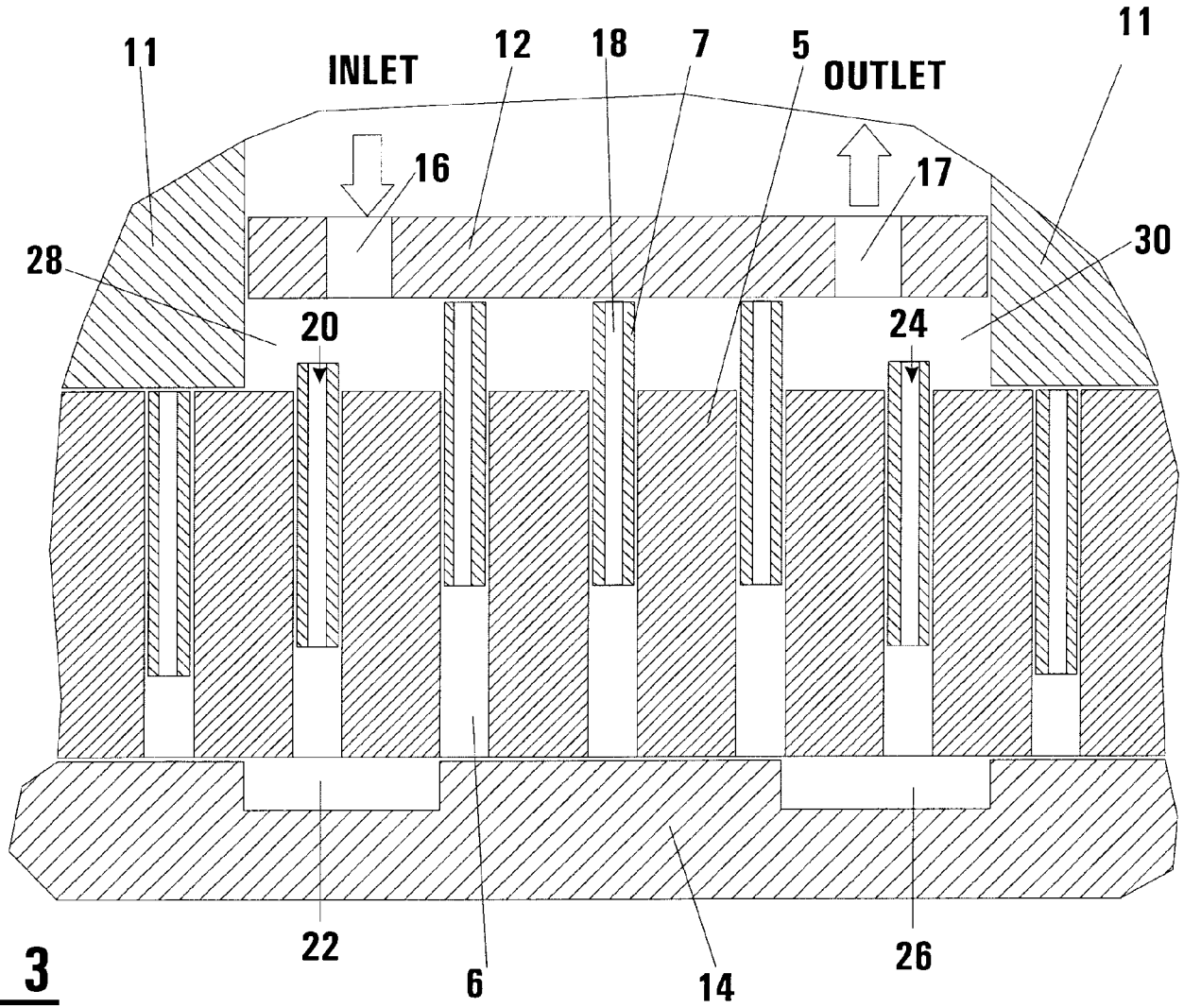
FIG. 3 shows a development of the rotor and side cylindrical surface of the machine with channels through the slide valves.

In order to reduce hydraulic losses during reciprocating motions of slide valves, to reduce slide valve weight, and/or to balance the force of pressure acting on the slide valves, as shown in FIG. 3, a through channel (18) may be provided in each slide valve. Each channel (18) may begin on the slide valve end facing the working chamber and end on the slide valve end opposite to the said slide valve end.

What is claimed is:

1. A rotor machine comprising:

a housing with an inlet opening and an outlet opening;

a hollow cylinder in adjustable sliding connection with the housing, wherein the hollow cylinder includes a sinusoidal-like guide along an interior surface of the hollow cylinder;

a rotor in rotating connection within the housing, wherein the rotor is operative to rotate within the hollow cylinder, wherein the rotor includes at least two slide valves that can move along the axis of rotation of the rotor;

a working chamber restricted in a direction along a rotation axis of the rotor from one side by a first end of the rotor;

a partition in fixed connection with the housing and extending within the working chamber, wherein the partition is in sliding contact with the first end of the rotor and separates the inlet and the outlet openings;

a plurality of members in operative connection with the slide valves, wherein the plurality of members are in operative connection with the guide of the hollow cylinder and are operative to assign the axial mutual position of the slide valves, wherein the slide valves are mounted so that the slide valves can change position with respect to the housing and the rotor;

a regulating member in fixed connection with the hollow cylinder, wherein the regulating member is operative to move along the rotation axis of the rotor and restrict the size of the working chamber between the regulating member and the first end of the rotor, wherein the slide valves are operative to change position with respect to the rotor as the regulating member is moving.

2. The machine according to claim 1 further comprising a supporting and distributing member that is mounted inside the housing an end of which is in sliding contact with a second end of the rotor; wherein the supporting and distributing member includes two separated cavities connected by a channel with the inlet and outlet openings respectively.

3. A rotor machine comprising:

a housing with an inlet opening and an outlet opening;

a rotor mounted inside the housing with at least two slide valves that can move along the axis of rotation of the rotor;

a working chamber restricted in a direction along a rotation axis of the rotor from one side by a first end of the rotor;

a partition located inside the working chamber which is in sliding contact with the first end of the rotor and separates the inlet and the outlet openings;

a plurality of members in operative connection with the slide valves, wherein the plurality of members are operative to assign the axial mutual position of the slide valves, wherein the slide valves are mounted so that the slide valves can change position with respect to the housing and the rotor, wherein the slide valves are in kinematical connection with the housing and the rotor;

a regulating member that is located inside the housing opposite the first end of the rotor, wherein the regulating member is operative to move along the rotation axis of the rotor and restrict the size of the working chamber between the regulating member and the first end of the rotor, wherein the plurality of members are in kinematical connection with the regulating member, wherein the slide valves are operative to change position with respect to the rotor as the regulating member is moving, wherein areas of opposite rotor ends located between two adjacent slide valves are connected with channels provided in the rotor.

4. A rotor machine comprising:

a housing with an inlet opening and an outlet opening;

a rotor mounted inside the housing with at least two slide valves that can move along the axis of rotation of the rotor, wherein the rotor includes a first end and a second end, wherein the rotor includes channels between the first end and the second end of the rotor located between two adjacent slide valves;

a working chamber restricted in a direction along a rotation axis of the rotor from one side by the first end of the rotor;

a partition located inside the working chamber which is in sliding contact with the first end of the rotor and separates the inlet and the outlet openings;

a plurality of members in operative connection with the slide valves, wherein the plurality of members are operative to assign the axial mutual position of the slide valves, wherein the slide valves are mounted so that the slide valves can change position with respect to the housing and the rotor, wherein the slide valves are in kinematical connection with the housing and the rotor;

a regulating member that is located inside the housing opposite the first end of the rotor, wherein the regulating member is operative to move along the rotation axis of the rotor and restrict the size of the working chamber between the regulating member and the first end of the rotor, wherein the plurality of members are in kinematical connection with the regulating member, wherein the slide valves are operative to change position with respect to the rotor as the regulating member is moving; and a supporting and distributing member that is mounted inside the housing an end of which is in sliding contact with a second end of the rotor; wherein the supporting and distributing member includes two separated cavities connected by a channel with the inlet and outlet openings respectively.

5. A rotary machine comprising:

a housing;

a hollow cylinder in adjustable sliding connection with the housing, wherein the hollow cylinder includes a sinusoidal-like guide along an interior surface of the hollow cylinder;

a rotor in rotating connection within the housing, wherein the rotor is operative to rotate within the hollow cylinder, wherein the rotor includes a plurality of radially extending slots orientated parallel to a longitudinal axis of the rotor, wherein each slot includes a slide valve, wherein the valves are operative to slide longitudinally within the slots in a reciprocating motion responsive to the guide of the hollow cylinder; and a regulating member in fixed connection with a first end of the hollow cylinder adjacent a first end of the rotor, wherein adjustment of the position of the hollow cylinder with respect to the rotor is operative to change an axial length of a working chamber between the regulating member and the first end of the rotor.

6. A rotary machine comprising:

a housing;

a hollow cylinder in adjustable sliding connection with the housing, wherein the hollow cylinder includes a sinusoidal-like guide along an interior surface of the hollow cylinder, wherein the guide includes a recess;

a rotor in rotating connection within the housing, wherein the rotor is operative to rotate within the hollow cylinder, wherein the rotor includes a plurality of radially extending slots orientated parallel to a longitudinal axis of the rotor, wherein each slot includes a slide valve, wherein each slide valve includes a projection which is operative to slide within the recess of the guide, wherein the slide valves are operative to slide longitudinally within the slots in a reciprocating motion responsive to the guide of the hollow cylinder; and a regulating member in fixed connection with a first end of the hollow cylinder adjacent a first end of the rotor, wherein adjustment of the position of the hollow cylinder with respect to the rotor is operative to change an axial length of a working chamber between the regulating member and the first end of the rotor.

7. The rotary machine according to claim 5, wherein the rotor includes a shaft in rotating connection with the housing.

8. A rotary machine comprising:

a housing;

a hollow cylinder in adjustable sliding connection with the housing, wherein the hollow cylinder includes a sinusoidal-like guide along an interior surface of the hollow cylinder;

a rotor in rotating connection within the housing, wherein the rotor is operative to rotate within the hollow cylinder, wherein the rotor includes a plurality of radially extending slots orientated parallel to a longitudinal axis of the rotor, wherein each slot includes a slide valve, wherein the valves are operative to slide longitudinally within the slots in a reciprocating motion responsive to the guide of the hollow cylinder;

a partition in connection with the housing, wherein the partition extends within the hollow cylinder and is in sliding contact with the first end of the rotor; and a regulating member in fixed connection with a first end of the hollow cylinder adjacent a first end of the rotor, wherein adjustment of the position of the hollow cylinder with respect to the rotor is operative to change an axial length of a working chamber between the regulating member and the first end of the rotor.

9. The rotary machine according to claim 8, further comprising a supporting and distributing member in connection with the housing, wherein the supporting and distributing member extends within the hollow cylinder adjacent a second end of the rotor opposite the first end of the rotor.

10. A rotary machine comprising:

a housing;

a hollow cylinder in adjustable sliding connection with the housing, wherein the hollow cylinder includes a sinusoidal-like guide along an interior surface of the hollow cylinder;

a rotor in rotating connection within the housing, wherein the rotor is operative to rotate within the hollow cylinder, wherein the rotor includes a plurality of radially extending slots orientated parallel to a longitudinal axis of the rotor, wherein each slot includes a slide valve, wherein the slide valves are operative to slide longitudinally within the slots in a reciprocating motion responsive to the guide of the hollow cylinder, wherein at least one slide valve comprises a channel connecting two ends of the valve;

a partition in connection with the housing, wherein the partition extends within the hollow cylinder and is in sliding contact with the first end of the rotor; and a regulating member in fixed connection with a first end of the hollow cylinder adjacent a first end of the rotor, wherein adjustment of the position of the hollow cylinder with respect to the rotor is operative to change an axial length of a working chamber between the regulating member and the first end of the rotor;

a supporting and distributing member in connection with the housing, wherein the supporting and distributing member extends within the hollow cylinder adjacent a second end of the rotor opposite the first end of the rotor.

11. A rotary machine comprising:

a housing;

a hollow cylinder in adjustable sliding connection with the housing, wherein the hollow cylinder includes a sinusoidal-like guide along an interior surface of the hollow cylinder;

a rotor in rotating connection within the housing, wherein the rotor is operative to rotate within the hollow cylinder, wherein the rotor includes a plurality of radially extending slots orientated parallel to a longitudinal axis of the rotor, wherein each slot includes a slide valve, wherein the slide valves are operative to slide longitudinally within the slots in a reciprocating motion responsive to the guide of the hollow cylinder;

a partition in connection with the housing, wherein the partition extends within the hollow cylinder and is in sliding contact with the first end of the rotor; and a regulating member in fixed connection with a first end of the hollow cylinder adjacent a first end of the rotor, wherein adjustment of the position of the hollow cylinder with respect to the rotor is operative to change an axial length of a working chamber between the regulating member and the first end of the rotor;

a supporting and distributing member in connection with the housing, wherein the supporting and distributing member extends within the hollow cylinder adjacent a second end of the rotor opposite the first end of the rotor, wherein the rotor includes at least one channel between two adjacent slots, and wherein the at least one channel extends between the first end and the second end of the rotor.

12. The rotary machine according to claim 11, wherein the supporting and distributing member is operative to direct fluids into and out of the rotary machine.

13. A rotor machine comprising:

a housing with an inlet opening and an outlet opening;

a hollow cylinder in adjustable sliding connection with the housing, wherein the hollow cylinder includes a sinusoidal-like guide along an interior surface of the hollow cylinder;

a rotor, wherein the rotor is operative to rotate within the hollow cylinder, wherein the rotor includes a plurality of radially extending slots, wherein each slot includes a slide valve, wherein the slide valves are operative to slide longitudinally within the slots in a reciprocating motion responsive to the guide of the hollow cylinder a working chamber bounded on one side by a first end of the rotor;

a partition in fixed connection with the housing, wherein the partition extends within the hollow cylinder and the working chamber, wherein the partition is in sliding contact with the first end of the rotor and separates the inlet and the outlet openings; and a supporting and distributing member in fixed connection with the housing, an end of which extends within the hollow cylinder and is in sliding contact with a second end of the rotor, wherein the supporting and distributing member includes two separated cavities connected by a channel with the inlet and outlet openings respectively.

14. The machine according to claim 13, wherein the hollow cylinder includes a regulating member bounding a second side of the working chamber, wherein the hollow cylinder and regulating member are operative to move along the rotation axis of the rotor and change the size of the working chamber located between the regulating member and the first end of the rotor, wherein the slide valves are operative to change position with respect to the rotor as the hollow cylinder and regulating member move along the rotation axis of the rotor, wherein at least a portion of the partition extends through the regulating member.

15. A rotor machine comprising:

a housing with an inlet opening, an outlet opening and insulation members;

a rotor mounted inside the housing with at least two slide valves that can move along the axis of rotation of the rotor, wherein areas of opposite rotor ends located between two adjacent slide valves are connected with channels provided in the rotor;

a working chamber restricted in a direction along a rotation axis of the rotor from one side by a first end of the rotor;

a partition located inside the working chamber which is in sliding contact with the first end of the rotor and separates the inlet and the outlet openings;

a plurality of members in operative connection with the slide valves, wherein the plurality of members are operative to assign the axial mutual position of the slide valves, wherein the slide valves are mounted so that the slide valves can change position with respect to the housing and the rotor, wherein the slide valves are in kinematical connection with the housing and the rotor;

a supporting and distributing member that is mounted inside the housing an end of which is in sliding contact with a second end of the rotor, wherein the supporting and distributing member includes two separated cavities connected by a channel with the inlet and outlet openings respectively.

16. A rotor machine comprising:

a housing with an inlet opening, an outlet opening and insulation members;

a rotor mounted inside the housing with at least two slide valves that can move along the axis of rotation of the rotor, wherein at least one slide valve comprises a channel connecting two ends of the slide valve;

a working chamber restricted in a direction along a rotation axis of the rotor from one side by a first end of the rotor;

a partition located inside the working chamber which is in sliding contact with the first end of the rotor and separates the inlet and the outlet openings;

a plurality of members in operative connection with the slide valves, wherein the plurality of members are operative to assign the axial mutual position of the slide valves, wherein the slide valves are mounted so that the slide valves can change position with respect to the housing and the rotor, wherein the slide valves are in kinematical connection with the housing and the rotor;

a supporting and distributing member that is mounted inside the housing an end of which is in sliding contact with a second end of the rotor; wherein the supporting and distributing member includes two separated cavities connected by a channel with the inlet and outlet openings respectively.

17. The rotary machine according to claim 13, wherein the supporting and distributing member is operative to direct fluids into and out of the rotary machine.

18. A rotary machine comprising:

a housing a hollow cylinder in adjustable sliding connection with the housing, wherein the hollow cylinder includes a sinusoidal-like guide along an interior surface of the hollow cylinder;

a rotor in rotating connection within the housing, wherein the rotor is operative to rotate within the hollow cylinder, wherein the rotor includes a plurality of radially extending slots orientated parallel to a longitudinal axis of the rotor, wherein each slot includes a slide valve, wherein the valves are operative to slide longitudinally within the slots in a reciprocating motion responsive to the guide of the hollow cylinder, wherein the rotor includes a first end and a second end opposite the first end;

a supporting and distributing member in connection with the housing, wherein the supporting and distributing member extends within the hollow cylinder adjacent the second end of the rotor.

19. The rotary machine according to claim 18, wherein the guide includes a recess, wherein each slide valve includes a projection which is operative to slide within the recess.

20. The rotary machine according to claim 18, further comprising a partition in connection with the housing, wherein the partition extends within the hollow cylinder and is in sliding contact with the first end of the rotor.

21. The rotary machine according to claim 18, further comprising a regulating member in fixed connection with a first end of the hollow cylinder adjacent the first end of the rotor, wherein adjustment of the position of the hollow cylinder with respect to the rotor is operative to change an axial length of a working chamber between the regulating member and the first end of the rotor.

22. The rotary machine according to claim 18, wherein the supporting and distributing member is operative to direct fluids into and out of the rotary machine.

23. A rotary machine comprising:

a housing;

a hollow cylinder in adjustable sliding connection with the housing, wherein the hollow cylinder includes a sinusoidal-like guide along an interior surface of the hollow cylinder;

a rotor in rotating connection within the housing, wherein the rotor is operative to rotate within the hollow cylinder, wherein the rotor includes a plurality of radially extending slots orientated parallel to a longitudinal axis of the rotor, wherein each slot includes a slide valve, wherein the slide valves are operative to slide longitudinally within the slots in a reciprocating motion responsive to the guide of the hollow cylinder, wherein at least one slide valve comprises a channel connecting two ends of the valve, wherein the rotor includes a first end and a second end opposite the first end; and a supporting and distributing member in connection with the housing, wherein the supporting and distributing member extends within the hollow cylinder adjacent the second end of the rotor.

24. A rotary machine comprising:

a housing;

a hollow cylinder in adjustable sliding connection with the housing, wherein the hollow cylinder includes a sinusoidal-like guide along an interior surface of the hollow cylinder;

a rotor in rotating connection within the housing, wherein the rotor is operative to rotate within the hollow cylinder, wherein the rotor includes a plurality of radially extending slots orientated parallel to a longitudinal axis of the rotor, wherein each slot includes a slide valve, wherein the slide valves are operative to slide longitudinally within the slots in a reciprocating motion responsive to the guide of the hollow cylinder, wherein the rotor includes a first end and a second end opposite the first end, wherein the rotor includes at least one channel between two adjacent slots, and wherein the channel extends between the first end and the second end of the rotor; and a supporting and distributing member in connection with the housing, wherein the supporting and distributing member extends within the hollow cylinder adjacent the second end of the rotor.

25. A rotor machine comprising:

a housing with an inlet opening, an outlet opening, and insulation members;

a rotor mounted inside the housing with at least two slide valves that can move along the axis of rotation of the rotor, wherein the rotor includes slots, wherein the slide valves are located inside the slots in the rotor along an axial direction from the first end of the rotor;

a working chamber restricted in a direction along a rotation axis of the rotor from one side by the first end of the rotor;

a partition mounted in the housing inside the working chamber between the suction area communicating with the inlet opening and the injection area communicating with the outlet opening, which is in sliding contact with the first end of the rotor;

a plurality of members in operative connection with the lateral surfaces of the slide valves, wherein the plurality of members are operative to assign the axial mutual position of the slide valves, wherein the slide valves are mounted so that the slide valves can change position with respect to the housing and the rotor, wherein the slide valves are in kinematical connection with the housing and the rotor;

a regulating member that is located inside the housing opposite the first end of the rotor, wherein the regulating member is operative to move along the rotation axis of the rotor with regard to the housing and restrict the size of the working chamber between the regulating member and the first end of The rotor, wherein the plurality of members are in kinematical connection with the regulating member, wherein the slide valves are operative to change an axial position with respect to the rotor and the housing as the regulating member is moving relative to the housing.

26. The machine according to claim 25 further comprising a supporting and distribution member that is mounted inside the housing an end of which is in sliding contact with a second end of the rotor; wherein the supporting and distributing member includes two separated cavities one of which is located opposite the suction area of the working chamber and connected by a channel with the suction area, another one is located opposite the injection area of the working chamber, connecting with the injection area by a channel.

27. The machine according to claim 25, wherein the slide valves are located inside the slots passing through the rotor along an axial direction from the first end of the rotor to the second end of the rotor.

28. A rotor machine comprising:

a housing with an inlet opening and an outlet opening;

a rotor mounted inside the housing with at least two slide valves that can move along the axis of rotation of the rotor, wherein the rotor includes channels between the first end and the second end of the rotor located between two adjacent slide valves;

a working chamber restricted in a direction along a rotation axis of the rotor from one side by the first end of the rotor;

a partition mounted in the housing inside the working chamber between the suction area communicating with the inlet opening and the injection area communicating with the outlet opening, which is in sliding contact with the first end of the rotor;

a plurality of members in operative connection with the lateral surfaces of the slide valves, wherein the plurality of members are operative to assign the axial mutual position of the slide valves, wherein the slide valves are mounted so that the slide valves can change position with respect to the housing and the rotor, wherein the slide valves are in kinematical connection with the housing and the rotor;

a regulating member that is located inside the housing opposite the first end of the rotor, wherein the regulating member is operative to move along the rotation axis of the rotor with regard to the housing and restrict the size of the working chamber between the regulating member and the first end of the rotor, wherein the plurality of members are in kinematical connection with the regulating member, wherein the slide valves are operative to change an axial position with respect to the rotor and the housing as the regulating member is moving relative to the housing; and a supporting and distributing member that is mounted inside the housing an end of which is in sliding contact with a second end of the rotor; wherein the supporting and distributing member includes two separated cavities one of which is located opposite the suction area of the working chamber and connected by a channel with the suction area, another one is located opposite the injection area of the working chamber, connecting with the injection area by a channel.

29. The machine according to claim 28, wherein the rotor includes the slots, wherein the slide valves are located inside the slots passing through the rotor along an axial direction from the first end of the rotor to the second end of the rotor.

30. A rotary machine comprising:

a housing;

a hollow cylinder in adjustable sliding connection with the housing, wherein the hollow cylinder includes a sinusoidal-like guide along an interior surface of the hollow cylinder;

a rotor in rotating connection within the housing, wherein the rotor is operative to rotate within the hollow cylinder, wherein the rotor includes a plurality of radially extending slots orientated parallel to a longitudinal axis of the rotor starting and finishing at the opposite ends of the rotor, wherein each slot includes a slide valve, wherein the slide valves are operative to slide longitudinally within the slots in a reciprocating motion responsive to the guide of the hollow cylinder; and a regulating member in fixed connection with a first end of the hollow cylinder adjacent a first end of the rotor, wherein adjustment of the position of the hollow cylinder with respect to the housing and the rotor is operative to change an axial length of a working chamber between the regulating member and the first end of the rotor.

31. The rotary machine according to claim 30, wherein the rotor includes a shaft in rotating connection with the housing.

32. A rotary machine comprising:

a housing;

a hollow cylinder in adjustable sliding connection with the housing, wherein the hollow cylinder includes a sinusoidal-like guide along an interior surface of the hollow cylinder, wherein the guide includes a recess;

a rotor in rotating connection within the housing, wherein the rotor is operative to rotate within the hollow cylinder, wherein the rotor includes a plurality of radially extending slots orientated parallel to a longitudinal axis of the rotor starting and finishing at the opposite ends of the rotor, wherein each slot includes a slide valve, wherein each slide valve includes a projection which is operative to slide within the recess of the guide, wherein the slide valves are operative to slide longitudinally within the slots in a reciprocating motion responsive to the guide of the hollow cylinder; and a regulating member in fixed connection with a first end of the hollow cylinder adjacent a first end of the rotor, wherein adjustment of the position of the hollow cylinder with respect to the housing and the rotor is operative to change an axial length of a working chamber between the regulating member and the first end of the rotor.

33. A rotary machine comprising:

a housing;

a hollow cylinder in adjustable sliding connection with the housing, wherein the hollow cylinder includes a sinusoidal-like guide along an interior surface of the hollow cylinder;

a rotor in rotating connection within the housing, wherein the rotor is operative to rotate within the hollow cylinder, wherein the rotor includes a plurality of radially extending slots orientated parallel to a longitudinal axis of the rotor starting and finishing at the opposite ends of the rotor, wherein each slot includes a slide valve, wherein the slide valves are operative to slide longitudinally within the slots in a reciprocating motion responsive to the guide of the hollow cylinder;

a partition in connection with the housing, wherein the partition extends within the hollow cylinder and is in sliding contact with the first end of the rotor; and a regulating member in fixed connection with a first end of the hollow cylinder adjacent a first end of the rotor, wherein adjustment of the position of the hollow cylinder with respect to the housing and the rotor is operative to change an axial length of a working chamber between the regulating member and the first end of the rotor.

34. The rotary machine according to claim 33, further comprising a supporting and distributing member in connection with the housing, wherein the supporting and distributing member extends within the hollow cylinder adjacent a second end of the rotor opposite the first end of the rotor, wherein the supporting and distributing member includes two separated cavities one of which is located opposite the suction area of the working chamber and connected by a channel with the suction area, another one is located opposite the injection area of the working chamber, connecting with the injection area by a channel.

35. The machine according to claim 34, wherein the slide valves are located inside the slots passing through the rotor along an axial direction from the first end of the rotor to the second end of the rotor.

36. The rotary machine according to claim 34, wherein at least one slide valve comprises a channel connecting two ends of the valve.

37. The rotary machine according to claim 34, wherein the rotor includes at least one channel between two adjacent slots, and wherein the at least one channel extends between the first end and the second end of the rotor.

38. The rotary machine according to claim 37, wherein the supporting and distributing member is operative to direct fluids into and out of the rotary machine.

39. A rotor machine comprising:

a housing with an inlet opening, an outlet opening, and insulation members;

a rotor mounted inside the housing with at least two slide valves that can move along the axis of rotation of the rotor, wherein the rotor includes slots, wherein the slide valves are located inside the slots in the rotor along an axial direction from the first end of the rotor;

a working chamber restricted in a direction along a rotation axis of the rotor from one side by the first end of the rotor;

a partition mounted in the housing inside the working chamber between the suction area communicating with the inlet opening and the injection area communicating with the outlet opening, which is in sliding contact with the first end of the rotor;

a plurality of members in operative connection with the lateral surfaces of the slide valves, wherein the plurality of members are operative to assign the axial mutual position of the slide valves, wherein the slide valves are mounted so that the slide valves can change position with respect to the housing and the rotor, wherein the slide valves are in kinematical connection with the housing and the rotor;

a supporting and distributing member that is mounted inside the housing an end of which is in sliding contact with a second end of the rotor; wherein the supporting and distributing member includes two separated cavities one of which is located opposite the suction area of the working chamber and connected by a channel with the suction area, another one is located opposite the injection area of the working chambers connecting with the injection area by a channel.

40. The machine according to claim 39 further comprising a regulating member that is located inside the housing opposite the first end of the rotor, wherein the regulating member is operative to move along the rotation axis of the rotor with regard to the housing and restrict the size of the working chamber between the regulating member and the first end of the rotor, wherein the plurality of members are in kinematical connection with the regulating member, wherein the slide valves are operative to change an axial position with respect to the rotor and the housing as the regulating member is moving relative to the housing.

41. The machine according to claim 39, wherein the slide valves are located inside the slots passing through the rotor along an axial direction from the fist end of the rotor to the second end of the rotor.

42. The machine according to claim 39, wherein areas of opposite rotor ends located between two adjacent slide valves are connected with channels provided in the rotor.

43. The machine according to claim 39, wherein at least one slide valve comprises a channel connecting two ends of the valve.

44. The machine according to claim 39, wherein the supporting and distributing member is operative to direct fluids into and out of the rotary machine.

45. A rotary machine comprising:

a housing;

a hollow cylinder in adjustable sliding connection with the housing, wherein the hollow cylinder includes a sinusoidal-like guide along an interior surface of the hollow cylinder;

a rotor in rotating connection within the housing, wherein the rotor is operative to rotate within the hollow cylinder, wherein the rotor includes a plurality of radially extending slots orientated parallel to a longitudinal axis of the rotor starting and finishing at the opposite ends of the rotor, wherein each slot includes a slide valve, wherein the valves are operative to slide longitudinally within the slots in a reciprocating motion responsive to the guide of the hollow cylinder, wherein the rotor includes a first end and a second end opposite the first end;

a supporting and distributing member in connection with the housing, wherein the supporting and distributing member extends within the hollow cylinder adjacent the second end of the rotor, wherein the supporting and distributing member includes two separated cavities one of which is located opposite the suction area of the working chamber and connected by a channel with the suction area, another one is located opposite the injection area of the working chamber, connecting with the injection area by a channel.

46. The rotary machine according to claim 45, wherein the guide includes a recess, wherein each slide valve includes a projection which is operative to slide within the recess.

47. The rotary machine according to claim 45, further comprising a partition in connection with the housing, wherein the partition extends within the hollow cylinder and is in sliding contact with the first end of the rotor.

48. The rotary machine according to claim 45, further comprising a regulating member in fixed connection with a first end of the hollow cylinder adjacent the first end of the rotor, wherein adjustment of the position of the hollow cylinder with respect to the rotor and the housing is operative to change an axial length of a working chamber between the regulating member and the first end of the rotor.

49. The machine according to claim 45, wherein the slide valves are located inside the slots passing through the rotor along an axial direction from the first end of the rotor to the second end of the rotor.

50. The rotary machine according to claim 45, wherein at least one slide valve comprises a channel connecting two ends of the valve.

51. The rotary machine according to claim 45, wherein the rotor includes at least one channel between two adjacent slots, and wherein the channel extends between the first end and the second end of the rotor.

52. The rotary machine according to claim 45, wherein the supporting and distributing member is operative to direct fluids into and out of the rotary machine.

* * * * *